US005134848A

United States Patent [19]

Taniguchi et al.

[11] Patent Number: 5,134,848

[45] Date of Patent: Aug. 4, 1992

[54] STIRLING CYCLE APPARATUS

[75] Inventors: Hiroya Taniguchi, Hekinan; Hiroyasu Nomachi, Okazaki, both of Japan

[73] Assignee: Aisin Seiki Kabushiki Kaisha, Kariya, Japan

[21] Appl. No.: 757,528

[22] Filed: Sep. 11, 1991

[30] Foreign Application Priority Data

Sep. 11, 1990 [JP] Japan ..... 2-239039

[51] Int. Cl.[5] ..... F02G 1/053

[52] U.S. Cl. ..... 60/517; 60/525

[58] Field of Search ..... 60/517, 525; 62/6

[56] References Cited

U.S. PATENT DOCUMENTS 4,712,378 12/1987 Nakayama ..... 60/517 X 4,751,819 6/1988 Eder ..... 60/517

*Primary Examiner*—Allen M. Ostrager

*Attorney, Agent, or Firm*—Burns, Doane, Swecker & Mathis

[57] ABSTRACT

A stirling cycle apparatus having a buffer connecting the compressor piston back room with the expansion piston back room. The apparatus also has a diaphragm which divides the buffer and the crank room. The buffer reduces the pressure changes between the both sides of the diaphragm so that the stress to the diaphragm can be reduced.

1 Claim, 1 Drawing Sheet

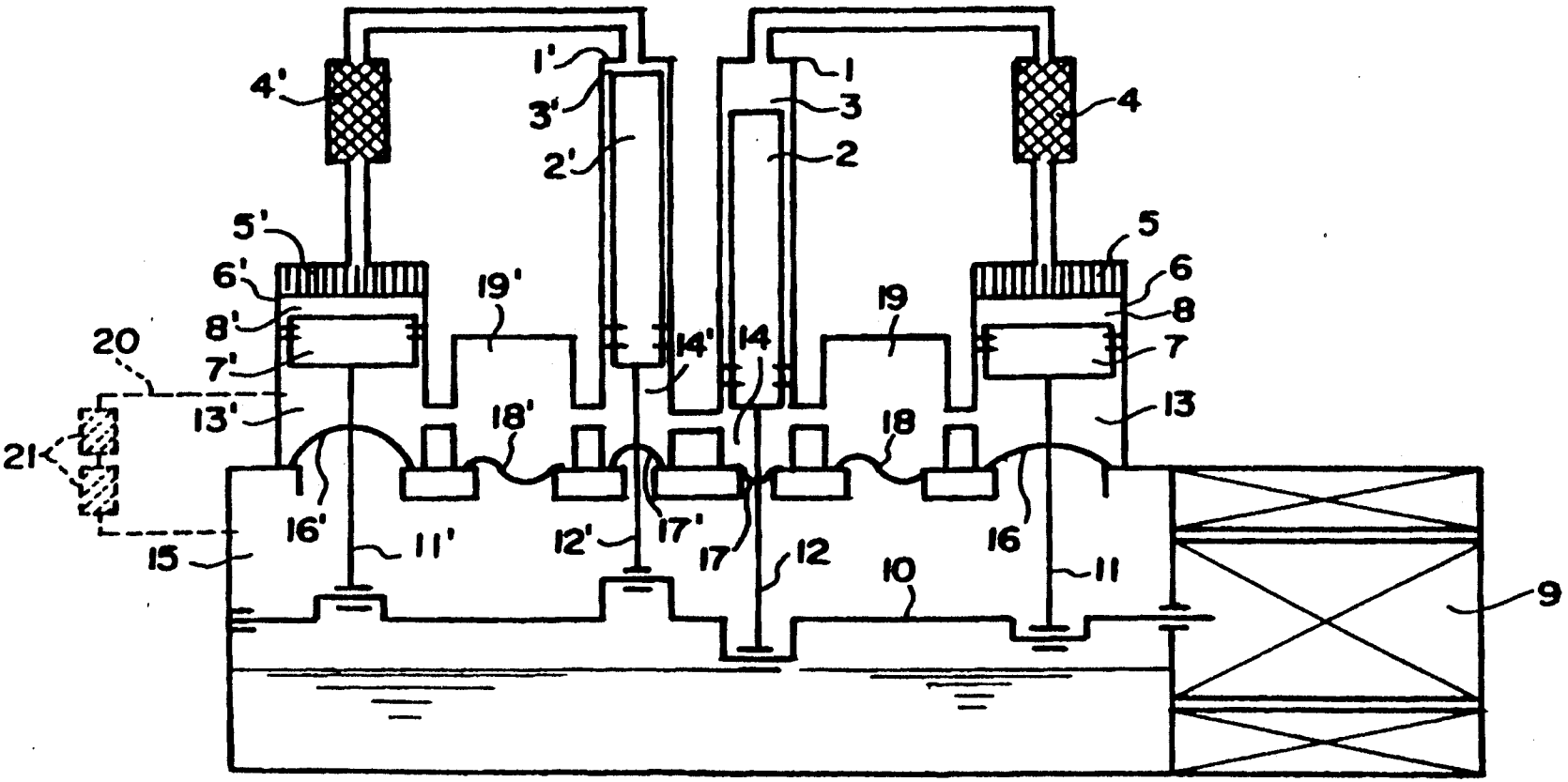
9
4
5
6
8
7
13
11
16
19
18
10
1
3
2
12
14
17
14'
17'
1'
3'
2'
12'
19'
18'
11'
4'
5'
6'
8'
7'
13'
16'
15
20
21

STIRLING CYCLE APPARATUS

BACKGROUND OF THE INVENTION

1. Field of the Invention

This invention relates to a Stirling cycle apparatus or a reverse Stirling cycle apparatus, especially to a Stirling cycle apparatus having a diaphragm which divides a piston back side room and a crank room.

2. Description of Prior Art

A conventional Stirling cycle apparatus, for example a Stirling engine, uses an operational fluid. The operational fluid is cooled or heated and is sent to the expansion cylinder or the compressor cylinder. The expansion cylinder and the compressor cylinder driven by the operational fluid rotate the crank shaft through the piston and the rod. An output shaft connected to the crank shaft supplies the rotational energy as an output power.

A conventional reverse Stirling cycle apparatus, for example a Stirling cycle cooling apparatus or a Stirling cycle compressor, has a motor to rotate the crank shaft. The crank shaft moves the expansion piston and the compressor piston through the rod. The operational fluid in the cylinder is compressed or expanded to take the heat away or to generate the heat.

In this type of Stirling cycle apparatus, a diaphragm dividing the piston back side room and the crank room is attached to the rod which connects the compressor and expansion pistons with the rod. This diaphragm prevents the oil from leak. The volume changes of the piston back side room due to a pressure change may break the diaphragm.

In order to solve this problem, two compressor pistons are placed in 180 degrees to each other and one crank pin is connected to the pistons so that the volume change at the diaphragm has a 180 degree phase difference. Further the piston back side rooms are connected to each other to prevent the volume changes. In this mechanism, however, the torque change in accordance with the movement of the compressor piston is too big and makes too much vibrations and noise. This is due to the arrangement of the two pistons in 180 degrees. The two pistons must be placed in 90 degrees to cut the torque change down. But the load to the diaphragm caused by the volume change of the piston back side room and the crank room becomes another problem. In order to reduce such load, it is easy to use a buffer tank which is connected to the upper room of the diaphragm. It is required, however, a bigger buffer tank to reduce the pressure changes small enough.

The object of the present invention is to provide a Stirling cycle apparatus having improved the above-mentioned drawbacks.

The object of the present invention is to provide a Stirling cycle apparatus has an improved simpler mechanism to reduce the pressure changes to prevent the diaphragm from breaking.

Other objects will be apparent from an understanding of the invention.

In accordance with this invention, a Stirling cycle apparatus comprises of: a cylinder, a compressor piston, an expansion piston, a crank room at the back side of the compressor and expansion pistons, a crank shaft placed in the crank room, a rod connecting the compressor piston with the crank shaft, a rod connecting the expansion piston with the crank shaft, a compressor piston back side room at the back side of the compressor piston, an expansion piston back side room at the back side of the expansion piston, a buffer connecting the compressor piston back side room with the expansion piston back side room, and a diaphragm dividing the buffer and the crank room.

In accordance with the present invention, the pressures at the compressor piston back side room and the expansion piston back side room become the same as the pressure at the buffer. Further, the diaphragm is placed at the rod between the buffer and the crank room so that the pressure changes caused by the volume change between the piston back rooms and the crank room can be absorbed by the diaphragm. The diaphragm at the rod can be moved in accordance with the movement of the rod. Thus the diaphragm is prevented from breaking due to the stress. Further more in this invention, the pressure difference between the upper side of the diaphragm and the lower side of the diaphragm is reduced by a simple mechanism. The stress to the diaphragm is also reduced to make the diaphragm life longer. It will become available to place the piston without considering the pressure changes at the piston back side room and the crank room. Thus the torque change is also reduced.

BRIEF DESCRIPTION OF THE DRAWINGS

The objects and advantages of the invention will become apparent from the following detailed description of the preferred embodiment thereof, in connection with the accompanying drawing in which;

FIGURE is a schematic diagram of a Stirling cycle apparatus of the present invention.

DETAILED DESCRIPTION OF THE PREFERRED EMBODIMENT

A preferred embodiment of a Stirling cycle apparatus is shown in FIGURE. This embodiment is a cooling device using a reverse Stirling cycle apparatus.

Expansion rooms 3, 3' are made of expansion cylinders 1, 1' and expansion pistons 2, 2'. Compressor rooms 8, 8' are made of compressor cylinders 6, 6' and compressor pistons 7, 7'. The expansion rooms 3, 3' are connected to the compressor rooms 8, 8' through a radiator, accumulators 4, 4' and heat exchangers 5, 5'. This consists a reverse Stirling cycle mechanism.

A crank shaft 10 driven by a motor 9 is connected to the compressor pistons 7, 7' and the expansion pistons 2, 2' through rods 11, 11' and 12, 12'. The compressor pistons 7, 7' reciprocate in about 90 degree delay with respect to the expansion pistons 2, 2'. At the reverse Stirling cycle mechanism, a cooling heat occurs at the expansion rooms 3, 3'. The expansion pistons 2, 2' of the reverse Stirling mechanisms operate in 90 degree phase difference. Diaphragms 16, 16' and 17, 17' divide the piston back side rooms 13, 13' and 14, 14' and the crank room 15 contains the crank shaft 10. The circumference of the diaphragms are connected to the lower end of the cylinder and the center of the diaphragms are connected to the rods 11, 11' and 12, 12'.

Buffers 19, 19' connect the compressor piston back side rooms 13, 13' and to the expansion piston back side rooms 14, 14'. Diaphragms 18, 18' divide the buffers 19, 19' and the crank room 15.

The movements of the compressor pistons 7, 7' and the expansion pistons 2, 2' change the volume of the piston back side rooms 13, 13', 14, 14' and the crank room 15. This volume changes make a pressure difference at the diaphragms 16, 16', 17, 17'. The fluid at the piston back side rooms 13, 13', 14, 14' flow into the buffers 19, 19'. The pressure differences between the buffers 19, 19' and the crank room 15 are absorbed by the diaphragms 18, 18'. This keeps the diaphragms 16, 16', 17, 17' of the rods 11, 11', 12, 12' away from the pressure so the diaphragms 16, 16', 17, 17' are in safe without any damages.

As shown in FIGURE in dotted line, a line 20 with an oil mist filter or with an absorber 21 may connect the piston back side rooms 13, 13', 14, 14' and the buffers 19, 19' with the crank room 15. If the pressure of the piston back side room drops and the pressure occurs between the crank room, the pressure is released to the crank room 15 through the line 20. This prevents the diaphragms from the excess pressure by keeping the pressure constant.

Although the invention has been described in its preferred form with a certain degree of particularity, obviously many changes and variations are possible therein. It is therefore to be understood that the present invention may be practiced otherwise than specifically described herein without departing from the scope and spirit thereof.

What is claimed is:

1. A Stirling cycle apparatus comprising;

a cylinder, a compressor piston, an expansion piston, a crank room at the back side of said compressor and expansion pistons, a crank shaft placed in said crank room, a rod connecting said compressor piston with said crank shaft, a rod connecting said expansion piston with said crank shaft, a compressor piston back room at the back side of said compressor piston, an expansion piston back room at the back side of said expansion piston, a buffer connecting said compressor piston back room with said expansion piston back room, and a diaphragm dividing said buffer and said crank room.

* * * * *